US006278423B1

(12) United States Patent
Wald et al.

(10) Patent No.: US 6,278,423 B1
(45) Date of Patent: Aug. 21, 2001

(54) ACTIVE MATRIX ELECTROLUMINESCENT GREY SCALE DISPLAY

(75) Inventors: Steven F. Wald, Tualatin; Terrance S. Larsson, Sherwood; Larry Arbuthnot, Beaverton; Eric Wald, Tualatin, all of OR (US)

(73) Assignee: Planar Systems, Inc, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/199,992

(22) Filed: Nov. 24, 1998

(51) Int. Cl.[7] ..... G09G 3/30

(52) U.S. Cl. ..... 345/76; 345/77; 345/80; 345/92; 345/205; 345/206; 345/147; 345/148

(58) Field of Search ..... 345/76, 77, 80, 345/92, 205, 206, 147, 148

(56) References Cited

U.S. PATENT DOCUMENTS

| | | | | |
|---|---|---|---|---|
| 4,707,692 | * | 11/1987 | Higgins et al. | 345/204 |
| 4,929,058 | | 5/1990 | Numao | 350/333 |
| 4,958,105 | | 9/1990 | Young et al. | 315/169.3 |
| 5,302,966 | | 4/1994 | Stewart | 345/76 |
| 5,463,279 | | 10/1995 | Khormaei | 315/169.3 |
| 5,566,064 | * | 10/1996 | Schoenwald et al. | 363/132 |
| 5,642,018 | * | 6/1997 | Marcotte | 315/169.4 |
| 5,652,600 | * | 7/1997 | Khormaei et al. | 345/76 |
| 5,828,353 | * | 10/1998 | Kishi et al. | 345/55 |
| 5,877,735 | * | 3/1999 | King et al. | 345/76 |
| 5,917,471 | * | 6/1999 | Choi | 345/147 |
| 5,999,154 | * | 12/1999 | Yoshioda | 345/89 |
| 6,028,587 | * | 2/2000 | Igari | 345/147 |
| 6,034,659 | * | 3/2000 | Wald et al. | 345/76 |

OTHER PUBLICATIONS

Yamaguchi, T., "Improvement in PDP Picture Quality by Three–Dimensional Scattering of Dynamic False Countours," SID 96 Digest, 1996, 19.4, pp. 291–294, University of Electro–Communications, Tokyo, Japan.

Toda, K., "An Equalising Pulse Technique for Improving the Grey Scale Capability of Plasma Displays", Euro Display '96, 1996, 4.3, pp. 39–42, The University of Electro–Communications, Tokyo, Japan.

* cited by examiner

*Primary Examiner*—Richard Hjerpe
*Assistant Examiner*—Kevin M. Nguyen
(74) *Attorney, Agent, or Firm*—Chernoff, Vilhauer, McClung & Stenzel, LLP

(57) ABSTRACT

The system illuminates an active matrix EL device (AMEL) to provide a gray scale display. The device includes a first electrode layer comprising an active matrix of individually addressable pixel electrodes, a second electrode layer, and a thin film EL laminate stack including at least an EL phosphor layer and a dielectric layer. The stack is disposed between the first and second electrode layers. A first group of selected ones of the pixel electrodes are addressed with data signals during a first subframe time period where the first group includes fewer than all of the pixels electrodes of the display. The second electrode layer is driven during the first subframe time period with a first illumination signal. A second group of selected ones of the pixel electrodes are addressed with data signals during a second subframe time period where the second group includes at least one pixel electrode not included within the first group. The second electrode layer is driven during the second subframe time period with a second illumination signal.

27 Claims, 13 Drawing Sheets

INTERLACE GROUP 31 SUBFRAMES

| | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| 1 | ROWS(1,7,13... | 1 | 2 | | 4 | | | | 8 | | | | | | | 16 | | | | | | | | | | | | | | |
| 2 | ROWS(2,8,14... | | | | | | 1 | 2 | | 4 | | | | 16 | | | | | | | | | | | | | | 8 | | |
| 3 | ROWS(3,9,15... | | | | | | | | | | 1 | 4 | | | | 2 | | 8 | | | | | | | 16 | | | | | |
| 4 | ROWS(4,10,16... | | | | | | | | | | | | 2 | | 4 | | | | 8 | | | | | | | 1 | 16 | | | |
| 5 | ROWS(5,11,17... | | | 16 | | | | | | | | | | | | | | | | 1 | 2 | | 8 | | | | | | 4 | |
| 6 | ROWS(6,12,18... | | | | | 16 | | | | | | | | | | | | | | | | 2 | | 1 | 4 | | | 8 | | |

| INTERLACE GROUP | 31 SUBFRAMES | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| 1 | ROWS(1,7,13... | 1 | 2 | 4 | | | 8 | | | | | 16 | | | | | | | | | | | | | | | | | | | | |
| 2 | ROWS(2,8,14... | | | | 1 | 2 | | 4 | | | 16 | | | | | | | | | | | | | | | | | 8 | | | | |
| 3 | ROWS(3,9,15... | | | | | | | | 1 | 4 | | | | 2 | | 8 | | | | | | | | 16 | | | | | | | | |
| 4 | ROWS(4,10,16... | | | | | | | | | | | | 2 | | 4 | | | 8 | | | | | 1 | 16 | | | | | | | | |
| 5 | ROWS(5,11,17... | | | | | | | | | | | | | | | | | | 1 | 2 | | 8 | | | | | | | | 4 | | |
| 6 | ROWS(6,12,18... | | | | | 16 | | | | | | | | | | | | | | | 2 | | | | 1 | 4 | | | 8 | | | |

FIG. 12

+4V
418
COMPARATOR
INTEGRATOR
COMPARATOR
+2V
VREF
VLIMIT
PULSE
422
POL
420
424
426
HVOUT
+2V
100MA/200V
50MA/100V
0A/0V
-50MA/-100V
-100MA/-200V 462
464
T0
T1
T2
T3
T4

FIG. 20A

INTERLACE

| GROUP | ROW# | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| 1 | 1,11,21... | 1 | 2 | | 4 | | | | 8 | | | | | | | | 16 |
| 2 | 2,12,22... | | | 2 | | 1 | 4 | | | | 8 | | | | | | |
| 3 | 3,13,23... | | | | | | | 2 | | 4 | | | | 1 | 8 | | |
| 4 | 4,14,24... | | | | | | | | | | | 1 | 8 | | | | |
| 5 | 5,15,25... | | | | | | | | | | | | | | | 2 | |
| 6 | 6,16,26... | | | | | | | | | | | | | | | | |
| 7 | 7,17,27... | | | | | | | | | | | | | | | | |
| 8 | 8,18,28... | | | | | | | | | | | | | | | | |
| 9 | 9,19,29... | | | | | | | | | | | | | | | | |
| 10 | 10,20,30... | | | | | | | | | | | | | | | | |

| GROUP | ROW# | 17 | 18 | 19 | 20 | 21 | 22 | 23 | 24 | 25 | 26 | 27 | 28 | 29 | 30 | 31 |
|---|---|---|---|---|---|---|---|---|---|---|---|---|---|---|---|---|
| 1 | 1,11,21... | | | | | | | | | | | | | | | |
| 2 | 2,12,22... | | 16 | | | | | | | | | | | | | |
| 3 | 3,13,23... | | | | | | 18 | | | | | | | | | |
| 4 | 4,14,24... | | | | 4 | | | | 2 | | 16 | | | | | |
| 5 | 5,15,25... | 4 | | | | 8 | | | | | | | | 1 | 16 | |
| 6 | 6,16,26... | | | 4 | | | | 16 | | | | | | | | |
| 7 | 7,17,27... | | | | | | | | | 8 | | | | | | |
| 8 | 8,18,28... | | | | | | | | | | | 16 | | | | |
| 9 | 9,19,29... | | | | | | | | | | | | 8 | | | |
| 10 | 10,20,30... | | | | | | | | | | | | | | | 16 |

FIG. 20B

INTERLACE

| GROUP | ROW# | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|
| 1 | 1,11,21... | 32 | | | | | | | | | | | | | | | |
| 2 | 2,12,22... | | | 32 | | | | | | | | | | | | | |
| 3 | 3,13,23... | | | | | | | 32 | | | | | | | | | |
| 4 | 4,14,24... | | | | | | | | | | | 32 | | | | | |
| 5 | 5,15,25... | | | | | | | | | | | | | | | 32 | |
| 6 | 6,16,26... | | | | | | | | 1 | 8 | | | | | | | |
| 7 | 7,17,27... | | 2 | | 16 | | | | | | | | | | | | |
| 8 | 8,18,28... | | | | | | | | | | | | 1 | 8 | | | |
| 9 | 9,19,29... | | | | | 1 | 4 | | | | 16 | | | | | | |
| 10 | 10,20,30... | | | | | | | | | | | | | | | | 2 |

| GROUP | ROW# | 48 | 49 | 50 | 51 | 52 | 53 | 54 | 55 | 56 | 57 | 58 | 59 | 60 | 61 | 62 | 63 |
|---|---|---|---|---|---|---|---|---|---|---|---|---|---|---|---|---|---|
| 1 | 1,11,21... | | | | | | | | | | | | | | | | |
| 2 | 2,12,22... | | | | | | | | | | | | | | | | |
| 3 | 3,13,23... | | | | | | | | | | | | | | | | |
| 4 | 4,14,24... | | | | | | | | | | | | | | | | |
| 5 | 5,15,25... | | | | | | | | | | | | | | | | |
| 6 | 6,16,26... | 2 | | 32 | | | | | | 32 | | | | | | | |
| 7 | 7,17,27... | | | | 4 | | | | 1 | | | | | | | | |
| 8 | 8,18,28... | | | | | 2 | | 4 | | | | 32 | | | | | |
| 9 | 9,19,29... | | | | | | | | | | 2 | | 32 | | | | |
| 10 | 10,20,30... | | 4 | | | | 8 | | | | | | | | 1 | 32 | |

ACTIVE MATRIX ELECTROLUMINESCENT GREY SCALE DISPLAY

This application claims the benefit of the prior U.S. patent application Ser. No. 6,034,659.

BACKGROUND OF THE INVENTION

The present invention relates to an improved grey scale technique and driver circuit for an active matrix thin film electroluminescent device.

Traditional thin-film electroluminescent (TFEL) displays are normally constructed of a laminar stack comprising a set of transparent front electrodes, typically made of indium tin oxide, formed on a transparent substrate (glass), and a transparent electroluminescent phosphor layer sandwiched between front and rear dielectric layers situated behind the front electrodes. Situated behind the rear dielectric layer are rear electrodes oriented perpendicular to the front electrodes. To illuminate an entire display, each row electrode is sequentially selected and scanned, and column electrodes are simultaneously energized with voltage pulses to illuminate selected pixels in a row. All rows are scanned in turn until the entire display has been illuminated, thereby writing a frame of video data. The period for doing this is sometimes referred to as a frame time.

For a monochrome display, a grey scale is a desirable feature in order to provide better screen clarity and definition. Current techniques to achieve a grey scale for passive thin-film electroluminescent displays can be broadly categorized as the modulation of the amount of charge flow through the phosphor layer. Present modulation techniques may be divided into four subcategories, namely, amplitude modulation, pulse width modulation, frame averaging, and spatial dithering. These techniques have been used with traditional electroluminescent displays to achieve the grey scale.

Amplitude modulation is the modulation of the magnitude of the voltage pulses imposed across the electroluminescent layer. Different voltage pulse magnitudes within the operating range of the electroluminescent layer (typically 120 volts to 220 volts), cause different pixel brightness. Within certain limits a higher voltage pulse causes more light to be emitted than a lower voltage pulse. Amplitude modulation provides reasonably accurate results but accurate control of the column driver output voltage is difficult to maintain. The control circuitry required to provide reasonably accurate amplitude modulation of the applied voltage waveforms entails a substantial amount of circuitry, which in turn requires substantial silicon area to fabricate at increased expense.

Pulse width modulation is the control of the time duration of a voltage pulse imposed across the electroluminescent layer during each frame to control the amount of light emitted from the pixel. The total luminescence from a pixel increases with the increased duration of the voltage pulse. However, the capacitive nature of thin-film electroluminescent displays results in shadowing in the display when using pulse-width modulated waveforms. Also, thin-film electroluminescent displays are less sensitive to pulse width modulation than to amplitude modulation, thus achieving a grey scale display with pulse width modulated signals can lead to undesirable display artifacts.

Frame averaging may also be used to generate multiple grey levels in a thin-film electroluminescent display. Frame averaging is the illumination of pixels during different subframe time periods. The average illumination during each of the subframes results in the desired total luminescence output from each pixel within a frame. An example of such a technique is disclosed in U.S. patent application Ser. No. 08/383,902, assigned to the same assignee, and incorporated herein by reference. The electroluminescent layer inherently has a relatively fast refresh response time requiring the refresh rate of the display to be extremely high, when employing a large number of grey levels, to avoid flicker.

Another grey level technique is to spatially dither the data to create the illusion of a greater number of grey levels. Spatially dithering is usually undesirable because of the decreased resolution and other artifacts due to the coarseness of the image.

What is desired, therefore, is a grey scale technique that provides high luminance output, accurate grey levels, and minimizes display artifacts.

SUMMARY OF THE INVENTION

The present invention overcomes the aforementioned drawbacks of the prior art by providing in one aspect a system for illuminating an active matrix EL device (AMEL) to provide a gray scale display. The device includes a first electrode layer comprising an active matrix of individually addressable pixel electrodes, a second electrode layer, and a thin film EL laminate stack including at least an EL phosphor layer and a dielectric layer. The stack is disposed between the first and second electrode layers. A first group of selected ones of the pixel electrodes are addressed with data signals during a first subframe time period where the first group includes fewer than all of the pixels electrodes of the display. The second electrode layer is driven during the first subframe time period with a first illumination signal. A second group of selected ones of the pixel electrodes are addressed with data signals during a second subframe time period where the second group includes at least one pixel electrode not included within the first group. The second electrode layer is driven during the second subframe time period with a second illumination signal.

Another aspect of the present invention is a driver circuit suitable for illuminating an electroluminescent device. The driver circuit receives a low voltage generally DC input waveform and in response provides the input waveform to a first terminal of an inductor. The current from the input waveform is changed when passing through the inductor by alternatively increasing the current passing through the inductor thereby increasing energy stored in the inductor and thereafter decreasing the current passing through the inductor from the input waveform to cause a second terminal of the inductor to provide a high voltage generally sinusoidal waveform to the transparent electrode layer of the electroluminescent device.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 12 is a chart of the bit plane assignments for the gray scale technique of the present invention.

FIGS. 20A and 20B is an alternative chart of the bit plane assignments for the gray scale technique of the present invention.

DETAILED DESCRIPTION OF THE PREFERRED EMBODIMENT

Figure 1:
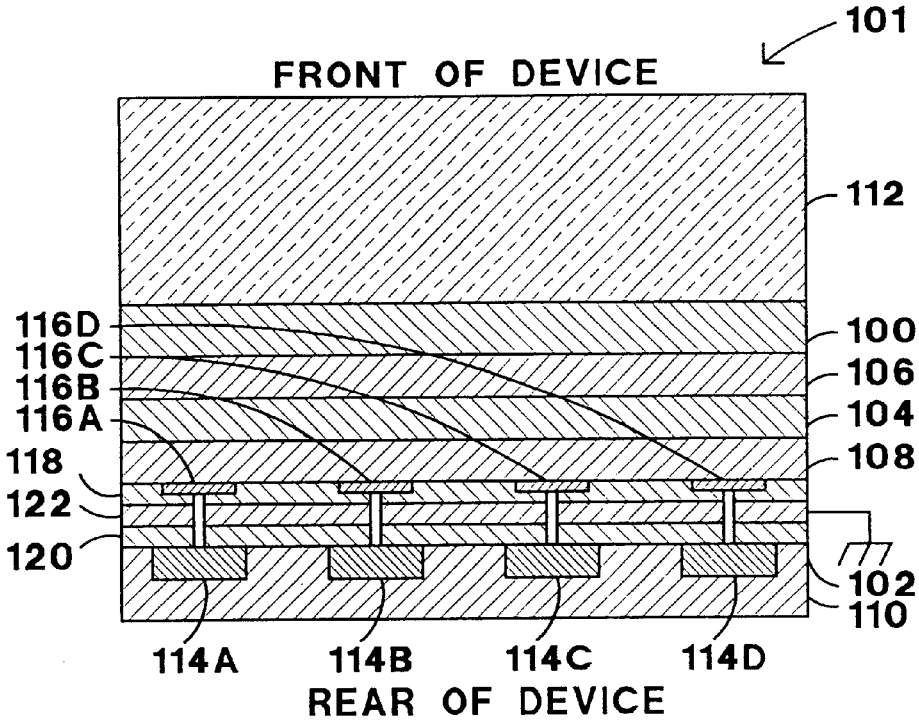
FIG. 1 is a cross sectional view of an AMEL device including a plurality of circuit elements.

Referring to FIG. 1, in contrast to a traditional passive thin-film electroluminescent device, an active matrix electroluminescent device (AMEL) 101 is constructed using an inverted structure. The structure includes a transparent electrode layer 100, a circuit layer 102, and at least three electroluminescent (EL) layers including an electroluminescent phosphor layer 104 sandwiched between front and rear dielectric layers 106 and 108, respectively. Alternatively, either the rear dielectric layer 108 or the front dielectric layer 106 may be omitted. The three EL layers are disposed between the circuit layer 102 and the transparent electrode layer 100. The circuit layer is deposited on a rearwardly disposed substrate 110. The rearwardly disposed substrate 110 is preferably a high purity silicon in which the circuit layer 102 is fabricated. A front glass plate 112 is affixed on the transparent electrode layer 100. Individual circuit elements 114*a*, 114*b*, 114*c* and 114*d* are connected to respective pixel electrodes 116*a*, 116*b*, 116*c* and 116*d*, with a metal line connected through a hole commonly referred to as a via in auxiliary ground layers. The auxiliary ground layers comprise a first isolation layer 118, a second isolation layer 120, and a ground plane layer 122, preferably made of refractory metals. The isolation layers 118 and 120 are preferably made of glass. The grounding for the individual circuit elements 114*a*–114*d* is preferably the rearwardly disposed substrate layer 110 or the ground plane layer 122.

Figure 2:
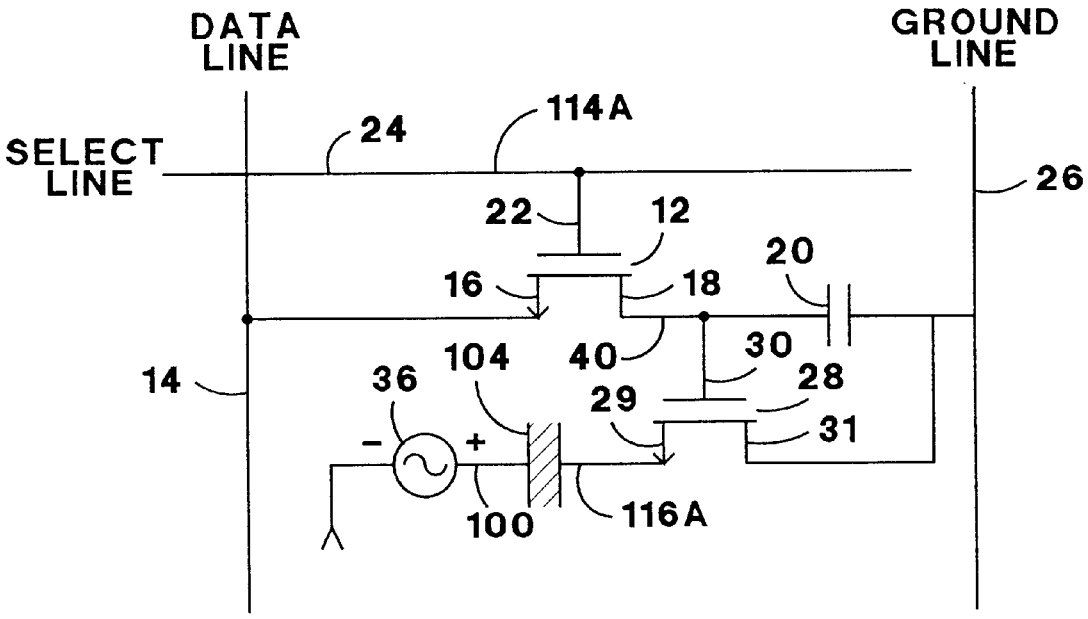
FIG. 2 is schematic of a circuit element of FIG. 1.

FIG. 2 is an electrical schematic of a circuit element 114*a* of the active matrix electroluminescent device 101 for selectively illuminating a respective pixel. A low voltage transistor 12, that is designed to handle signals up to the range of about 20 volts, gates a data signal (voltage signal) from a data line 14 connected to the low voltage transistor's source 16 to the low voltage transistor's drain 18. The drain 18 is connected to a hold capacitor 20, which in turn is connected to a ground line 26. In an actual fabricated AMEL device, the capacitor 20 is not generally fabricated as a discrete element, but is the capacitance of the line 40 between the low voltage transistor's drain 18 and a high voltage transistor's 28 gate 30, coupled to the ground line 26. The gate 22 of the low voltage transistor 12 is connected to a select line 24 to activate the low voltage transistor 12 to permit the selective gating of a data signal to the hold capacitor 20 for temporary storage. After gating the data signal to the hold capacitor 20, the select line 24 is typically then deselected, thereby isolating the hold capacitor 20 from the data line 14. The capacitor 20 maintains the applied voltage for a sufficient period of time for the illumination of a pixel. The capacitor 20 is also connected to the gate 30 of the high voltage transistor 28, which is designed to withstand voltages in the range of about 200 volts between its terminals. The high voltage transistor's drain 31 and source 29 are respectively connected between the ground line 26 and a respective pixel electrode 116*a*. The front electrode 100 carries a high AC voltage illumination signal powered by a voltage driver 36. By activating the base 30 of the high voltage transistor 28 with the electrical charge stored in the hold capacitor 20, after the low voltage transistor 12 has been deactivated or by the data signal directly when the low voltage transistor 12 is activated, the pixel electrode 116*a* is electrically connected to the ground line 26 by the high voltage transistor 28. By connecting the pixel electrode 116*a* to the ground line 26, an electric field is created between the respective portion of the front electrode 100 and the pixel electrode 116*a*, causing light to be emitted from the interdisposed electroluminescent layer 104.

Figure 3:
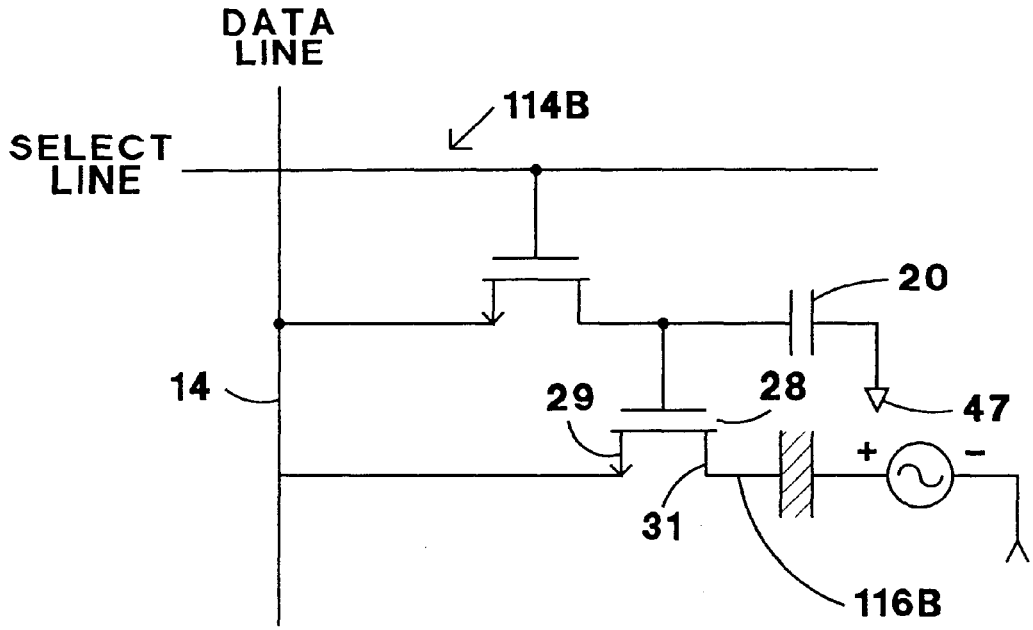
FIG. 3 is a schematic of an alternative circuit element of FIG. 1.

FIG. 3 is an alternative circuit element design 114*b*, which involves connecting the source 29 of the high voltage transistor 28 to the data line 14, the drain 31 to the pixel electrode 116*b*, and the capacitor 20 to a ground layer 47. The ground layer 47 is preferably the rearwardly disposed substrate 110 or the ground plane layer 122. Alternatively, the capacitor 20 could be connected to a ground line 26, as shown in FIG. 2.

Figure 4:
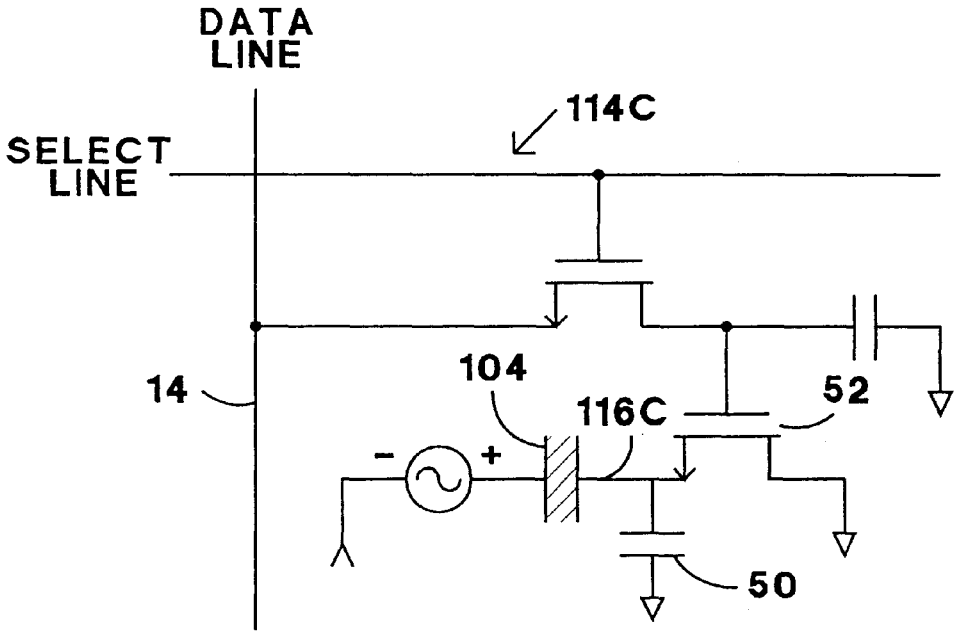
FIG. 4 is a schematic of a further alternative circuit element of FIG. 1.

FIG. 4 is another alternative circuit design 114*c*, which involves using a two-transistor, two-capacitor circuit. A capacitor 50 is provided between a high voltage transistor 52 and the pixel electrode 116*c*. Collectively, the capacitor 50 and the electroluminescent layer 104 act as a voltage divider reducing the voltage across the terminals of the high voltage transistor 52 when the transistor is off. The transistor 52, therefore, does not need to be designed to withstand the maximum applied voltage (200 volts).

Figure 5:
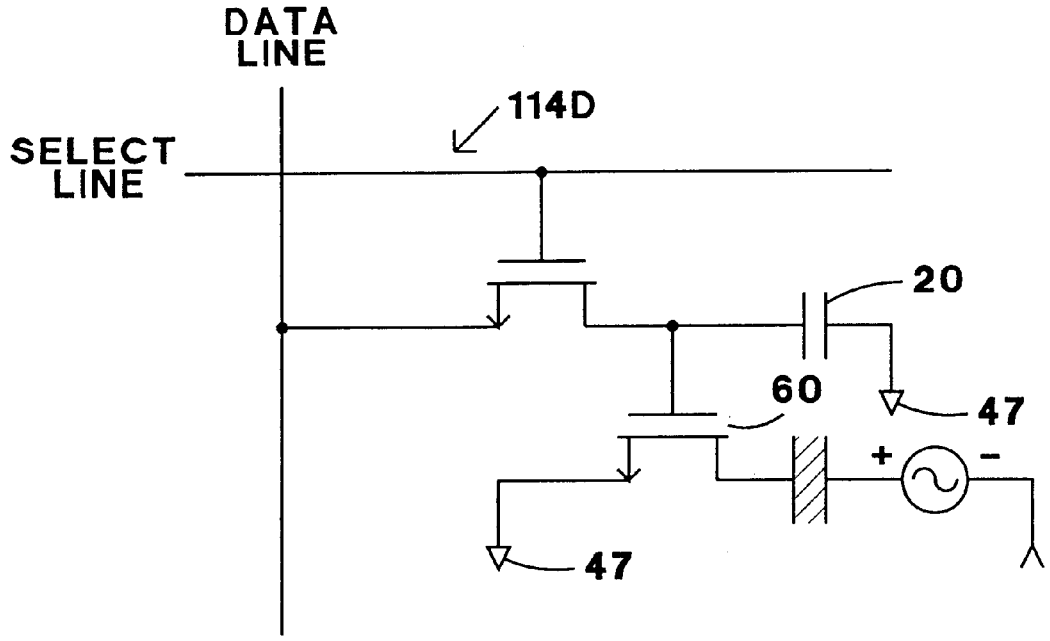
FIG. 5 is a schematic of yet a further alternative circuit element of FIG. 1.

FIG. 5 is still another alternative circuit element design 114*d*, which involves a high voltage transistor 60 operating in a breakdown region, and the capacitor 20 and the high voltage transistor 60 connected to a ground layer 47. Preferably, the high voltage transistor 60 maintains 80 volts across its terminals which prevents the electroluminescent layer from emitting light when deactivated.

Figure 6:
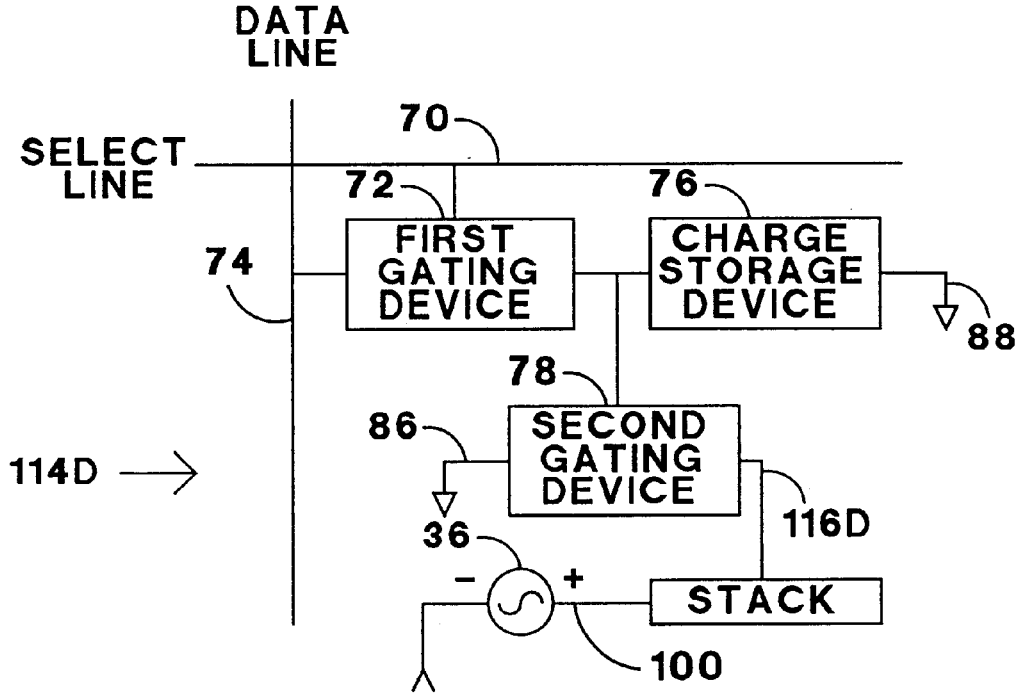
FIG. 6 is a block diagram of a circuit element.

FIG. 6 is a functional block diagram of a circuit element 114*d*. A select line 70 is activated causing a first gating device 72 to connect a data line 74 to a charge storage device 76 which in turn is connected to a ground 88. The charge storage device 76 is connected to and activates a second gating device 78 for connecting a pixel electrode 80 to a ground 86. The grounds 86 and 88 may be any suitable ground, such as the ground line 26, the ground plane layer 122, the grounded data line 74, or the substrate 110. During activation of the second gating device 78, the interdisposed electroluminescent layer 104 between the front electrodes 100 and a respective pixel electrode 116*d* is illuminated by a voltage driver 36. Using the combination of the first gating device 72, the charge storage device 76, and the second gating device 78, allows for the temporary storage of a data signal from the data line 74 for the illumination of a respective pixel. The key aspect of the active matrix electroluminescent display is a circuit element which can be selected to store or erase the pixel data voltage signal.

Figure 7:
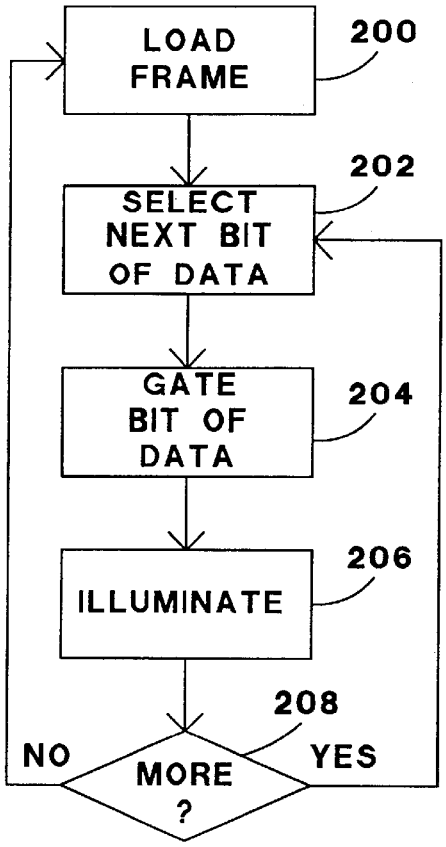
FIG. 7 is a flow chart of a bit plane gray scale technique.

FIG. 7 is an flow chart for one method of achieving a grey scale display. A frame of data consisting of a plurality of subframes, each of which contains one data bit of grey scale information, is loaded into memory at block 200 representative of the desired luminance for each individual pixel of the display. The data bits are arranged in order from the most significant bit to the least significant bit representative of a numerical value. A data bit is selected at block 202 from the frame for illumination of a pixel. At block 204, the data bit is gated from the first gating device 72 to the second gating device 78 by activation of the select line 70 coupled to the first gating device 72. The second gating device 78 is selectively activated depending upon the value of the data bit. At block 206, an illumination signal energizes the front electrode 100 for a predetermined period of time, preferably with voltage pulses, for illuminating the pixel within the electroluminescent layer. The period of time of illumination varies from subframe to subframe and is consistent with the value of the location of the data bit in the frame. In other words, in a frame of four data bits the most significant data bit would correspond to a duration twice the next significant bit, four times the next less significant bit, and eight times the least significant bit. Block 208 checks to see if all the data bits in the frame have been used. If there are additional data bits left to be used in the frame, then control is passed back to block 202 and the next data bit in the frame is processed. Alternatively, if there are no data bits left to process in the frame, then control is passed to block 200 to load the next frame of data for the respective pixel. By selecting a timing scheme for the duration of the illumination pulses for each subframe within a frame, in other words, a weighting scheme, and providing the appropriate data bits for the frame, a grey scale display with different luminance levels can be achieved.

Unfortunately, it has been observed by the present inventors that such a bit plane subframe grey scale technique is not linear and thus the gray scale display does not accurately represent the image.

Figure 8:
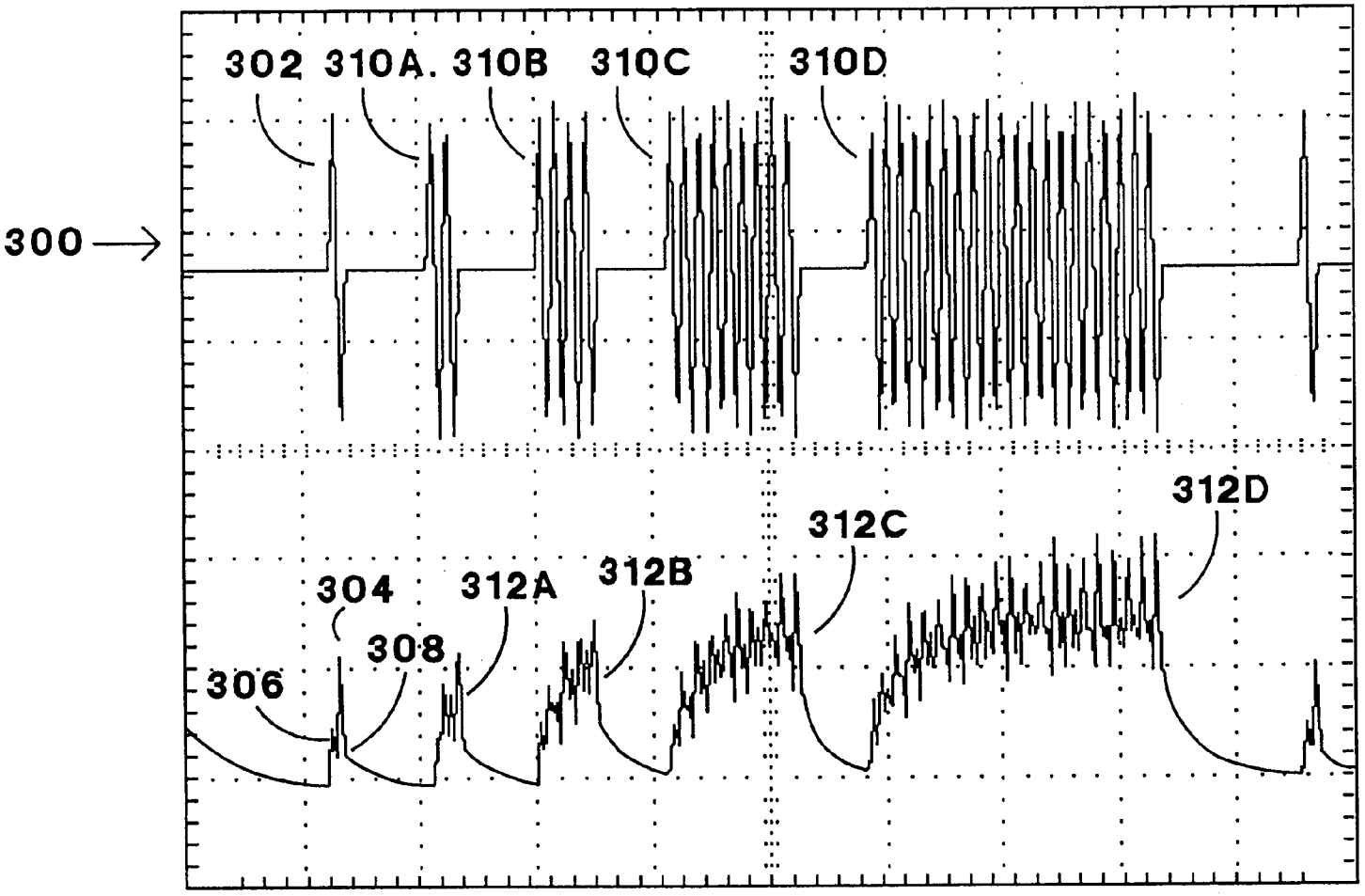
FIG. 8 is a graph of the luminance output of pixels using the bit plane gray scale technique of FIG. 7.

The present inventors came to the realization that a primary reason for the non-linearity of the aforementioned bit plane technique for achieving a grey scale display is based on the decay time of the electro-luminescent phosphors. Referring to FIG. 8, when an illumination signal 300 is applied to the phosphor the rise time of the luminance of the phosphor is relatively short and the decay time of the luminance of the phosphor is relatively long. More specifically, a single pulse illumination signal 302 causes the pixel to generate a luminance waveform 304 that clearly illustrates the fast rise time 306 and relatively long decay time 308. The total illumination from the pixel is directly proportional to the area under the luminance waveform 304. When an illumination signal 300 includes multiple pulses sufficiently close together the phosphor does not have sufficient time to fully decay between successive pulses, which limits its luminescence output. This is illustrated by the multiple illumination pulses 310*a*–310*d* and the corresponding pixel luminance waveforms 312*a*–312*d*. The total luminance output from a series of pulses timed close together is less than the total luminance output from the same number of pulses timed sufficiently apart to permit all or a substantial portion of the full luminance decay. Accordingly, the number of pulses timed close together must be greater than the number of pulses timed sufficiently far apart to provide the same luminance output. For example, twice as many pulses closely timed together does not double the perceived luminance output from a pixel. However, providing an additional time delay between pulses or providing additional pulses when using the aforementioned bit plane technique is not feasible because there is only a limited time duration available within a frame. Also, additional time delays between pulses result in fewer grey levels being achieved with the aforementioned bit plane technique.

The present inventors further realized that an additional limitation associated with the aforementioned bit plane technique is that the luminance response of the electroluminescent phosphor material is dependant on the particular type of phosphor material and varies between different batches of the same phosphor material. Accordingly, the number of pulses necessary for a given luminance response varies based on the type of phosphor material and varies from display to display even when using the same type of phosphor material. To overcome this limitation it is necessary to calibrate each display, which is expensive, time consuming, and may require additional electronic circuitry.

Figure 9:
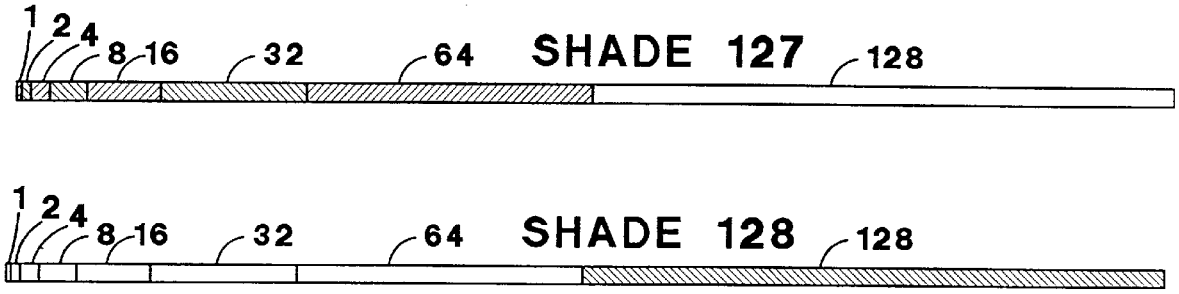
FIG. 9 is a graphical representation of two different gray scales.

Yet another limitation realized by the present inventors in employing the aforementioned bit plane grey scale technique is a dynamic contour effect. The dynamic contour effect primarily results from the same grey scale provided to the display using the same technique during sequential frames. The dynamic contour effect may be both spatial and temporal (time based). Spatial dynamic contour is the result of two similar grey scale shade regions adjacent to one another. As the viewer's eyes scan across the boundary between the two similar grey scale shades the eye perceives the difference as a line. The line is either perceived as a dark line or a bright line. Temporal dynamic contour results from the difference in time that different grey scales are presented to the viewer's eye. As the viewers' eyes scan across a boundary it expects to receive the two grey scale levels at the same time, but in fact the light arrives to the eye at different times. For example, referring to FIG. 9, an 8 bit grey scale illuminating a shade 127 involves illumination of the pixel during subframes 1 through 7. A shade 128 involves illumination of the pixel only during subframe 8. The result is that similar grey scale levels are perceived by the eye at different times and thus the boundary between them may appear as a line. One attempted remedy to the dynamic contour effect is to change the order of the pulses periodically on a frame by frame basis. However, this merely results in moving the dynamic contouring effect around in time.

For an AMEL display there is insufficient time to address the entire bit plane in a row by row manner between illumination signals if a high number of grey levels are desired. Accordingly, this addressing time limitation has further inhibited the ability to achieve an ever increasing number of grey levels for greater resolution. The present inventors came to the realization that in contrast to addressing the entire display between subframes, different sets of pixels within the bit plane could be addressed during different subframes. In other words, only a portion of the display is addressed during each subframe with the remaining nonaddressed pixels maintaining their current state as previously addressed in a previous subframe.

Figure 10:
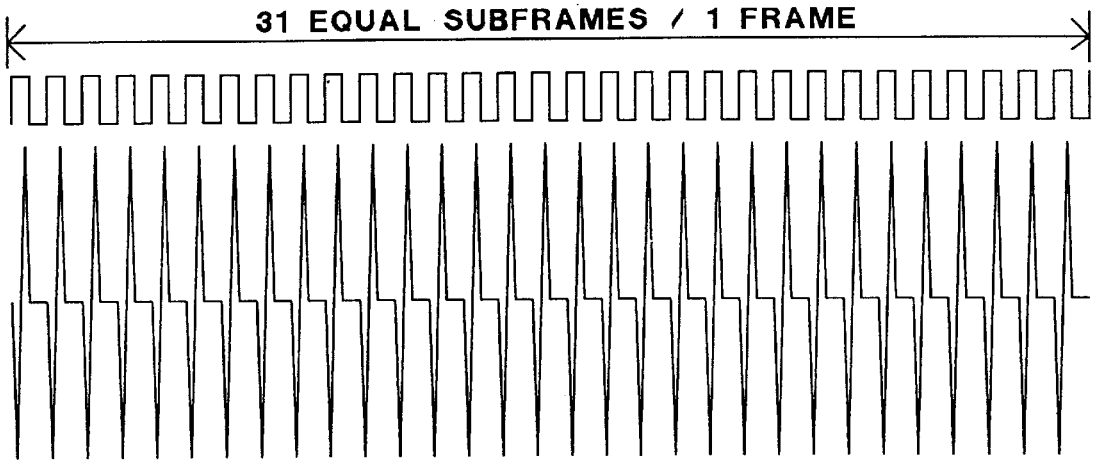
FIG. 10 is an exemplary timing diagram for the gray scale technique of the present invention.
Figure 11:
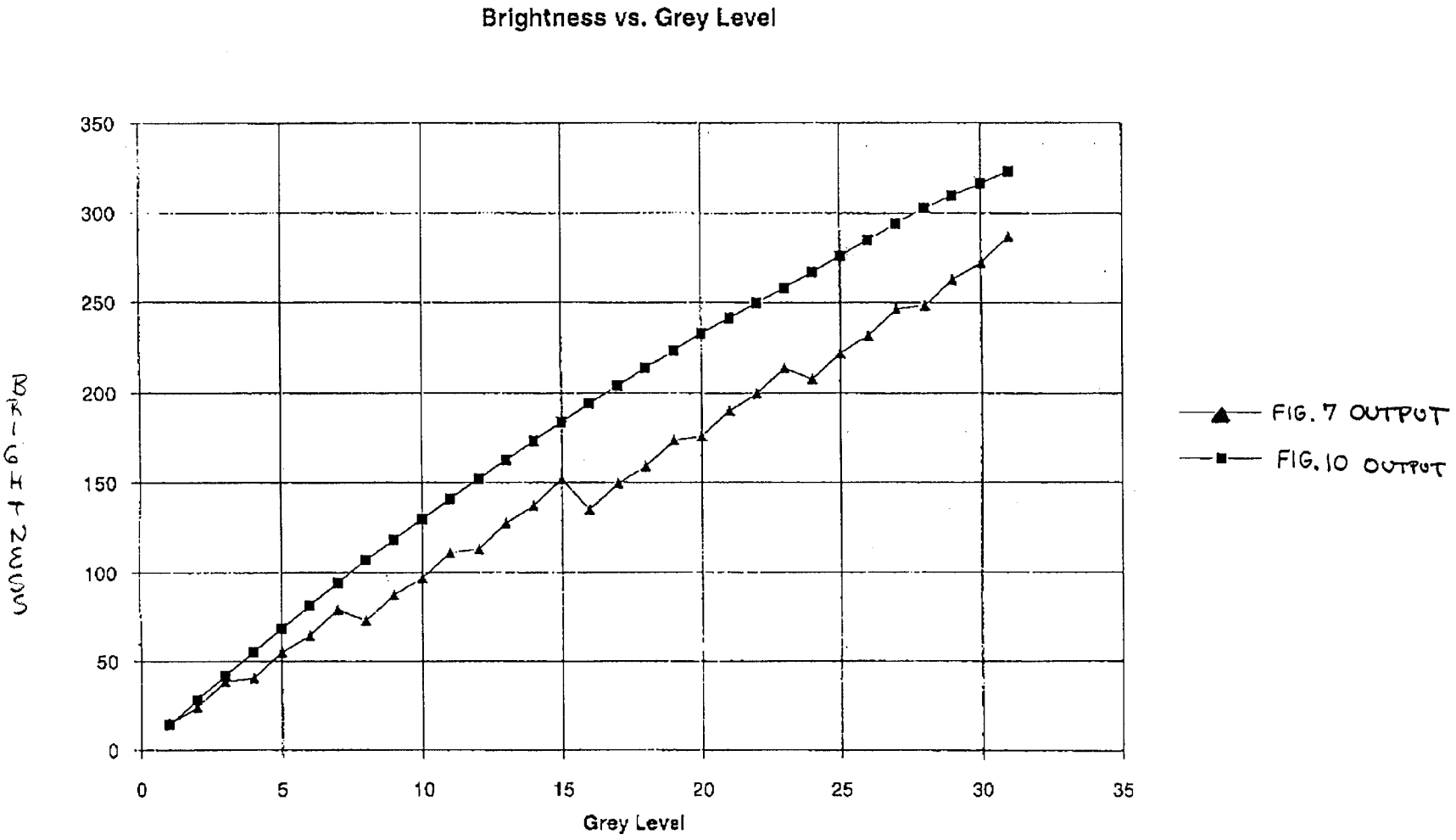
FIG. 11 is a graph of the luminance output for the gray scale technique of FIG. 10 versus the luminance output for the gray scale technique of FIG. 7.

Referring to FIG. 10, in order to increase the luminance of the pixels by permitting sufficient decay time between illumination pulses, the frame is partitioned into an equal number of subframe time periods, such as 31 subframe time periods. A single illumination pulse is provided to the display during each subframe time period. Also, during each subframe time period the pixels corresponding to each selected set of row electrodes are addressed to select whether those pixels are on or off. Alternatively, any suitable number of illumination pulses could be provided during each subframe time period and the subframes do not necessarily need to be of equal duration. Illuminating each pixel during a selected number of subframes permits one of a plurality of grey levels to be selected for each pixel. The grey scale technique shown in FIG. 10 permits sufficient time for the decay of the luminance from each pixel during each subframe time period which substantially increases the luminance output for the same number of illumination pulses as shown in FIG. 11.

In the preferred embodiment the rows are divided into a plurality of groups of rows and during each subframe time period the pixels of one group of rows are addressed. The row assignments for an 80 row device are preferably as follows:

ROWS

Group 1 1, 7, 13, 19, 25, 31, 37, 43, 49, 55, 61, 67, 73, 79
Group 2 2, 8, 14, 20, 26, 32, 38, 44, 50, 56, 62, 68, 74, 80
Group 3 3, 9, 15, 21, 27, 33, 39, 45, 51, 57, 63, 69, 75
Group 4 4, 10, 16, 22, 28, 34, 40, 46, 52, 58, 64, 70, 76
Group 5 5, 11, 17, 23, 29, 35, 41, 47, 53, 59, 65, 71, 77
Group 6 6, 12, 18, 24, 30, 36, 42, 48, 54, 60, 66, 72, 78

Referring to FIG. 12, each group includes a set of rows that are addressed during a portion of a subframe time period resulting in an "off" or an "on" state for each pixel of that selected group. During the remaining portion of the subframe time period the illumination waveform illuminates all of the pixels of the display having an "on" state, including pixels addressed during the current subframe time period and pixels addressed during preceding subframe time periods still maintaining their "on" states. Due to the capacitive nature of the circuit elements, pixels addressed during preceding subframe time periods maintain their "on" state or "off" state until addressed again and therefore are illuminated during the current subframe time period if their last addressed state was "on."

For example, to illuminate a pixel within one of the rows of group one during only one subframe time period, the system would addresses that pixel of group one during subframe one and store an "on" state at the pixel. Then the illumination waveform illuminates all selected pixels within the display. During subframe two that pixel is again addressed and turned "off." Then the illumination waveform illuminates all selected pixels within the display, which does not include the aforementioned pixel because it is turned "off." During the remainder of the frame that pixel remains "off" by not storing an "on" state at that pixel during any of the subsequent subframes.

As shown in FIG. 12, the interwoven grey scale system addresses one group during each subframe time period. For a five bit scheme each group is addressed five times during a frame. For example, the pixels of group one are addressed during the 1st, 2nd, 4th, 8th, and 16th subframes. Because each subframe permits sufficient time for the luminance of the pixel to substantially decay the illumination of the same pixel during sequential subframes linearly increases the luminance of the pixel. By addressing pixels of group one with "on" or "off" states during appropriate subframes 1, 2, 4, 8, and 16 a linear grey scale from 0 to 31 can be achieved. For example, to illuminate a pixel of group one with a gray scale of 10, the pixel is addressed during the frame as follows:

Subframe 1: "off"
Subframe 2: "on"
Subframe 4: "off"
Subframe 8: "on"
Subframe 16: "off"

In a similar manner groups two through six are addressed during different subframe time periods. The rows that are assigned to each group are preferably spaced apart from one another as much as possible. Accordingly, any dynamic contour artifacts, temporal and spatial, for the grey scale technique used for the rows of each group are spread across the entire display and are therefore nearly undetectable. In other words, for example, the spatial dynamic contour for group one would result from rows 1, 7, 13, 19, 25, 31, 37, 43, 49, 55, 61, 67, 73, and 79 which are sufficiently spaced apart that such effects would be difficult to detect. The illumination of pixels for groups two through six are each likewise spaced across the entire display, thus minimizing the spatial dynamic contour effect. In addition, the particular subframe time periods during which each of the groups provide the 1, 2, 4, 8, and 16 grey levels are likewise rearranged in order to minimize the temporal dynamic contour effect. In addition, because frames are sequential in nature the state of the pixels at the end of one frame is the same state of the pixels at the start of the next frame. Accordingly, the grey scale technique applied, in part, will overlap from frame to frame. For example, a pixel of group 2 illuminated during subframe 29 will still be illuminated during each subframe time period until at least subframe six of the next frame. In addition, improvements can be recognized by rotating the group assignments over time by assigning the rows to different groups and changing the addressing sequence within the rows.

AMEL displays frequently use a battery as its power source, so an efficient driver circuit 36 is desirable to maximize battery life. It turns out that reasonably efficient driver circuits can be constructed to provide bursts of high voltage illumination pulses. However, the load time during which the pixels are being addressed while the driver circuit electronics are not providing illumination pulses to the display is highly inefficient. Further, if the bursts are of variable duration then the driver circuits tend to be less efficient.

To increase efficiency, it is desirable to maintain the electronics of the driver circuit 36 operating at all times or with a pattern that has the same on and off time durations every cycle, if possible. However, this is not possible when the periodic off times are timed apart at different intervals in order to load and illuminate the pixels of the display, as in the aforementioned bit plane technique (FIG. 7). Also, the driver electronics need to be capable of providing peak power for the longest anticipated set of pulses which is considerably greater than the average power supplied to the display and normally requires additional electronics and larger capacitors, at added expense.

During the load time of the driver circuit 36 it is desirable to continue routing power somewhere, other than to the illumination signal of the display, in order to avoid turning the driver circuit off which results in excessive power consumption upon turning the driver circuit back on. In addition, turning the power off results in an input current upon start up, which has a relatively high power level and sharp transitions resulting in the introduction of excessive noise levels into the driver circuit and display. Further, to provide power from 0 volts (off) to a maximum voltage (in the range of 200 volts) requires a large capacitor to store sufficient energy to prevent the remainder of the driver circuit electronics from being pulled down in voltage toward ground. Also, the circuitry required for on/off operation is complicated and expensive.

Figure 13:
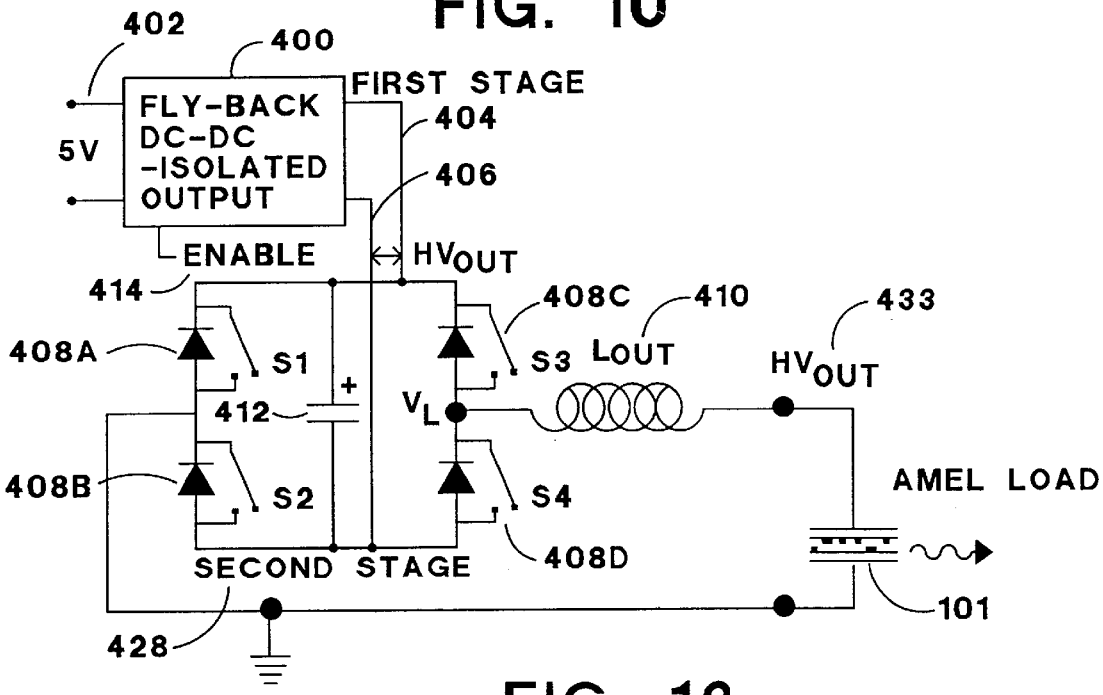
FIG. 13 is a partial schematic of an existing two stage driver circuit for an AMEL display.

Referring to FIG. 13, an existing two stage driver circuit includes a first stage with a dc-dc flyback switcher 400. The switcher 400 converts a low voltage dc input signal 402 of +12 volts or +5 volts, such as from a battery, to a positive high voltage dc signal output and a negative high voltage dc signal output, such as +/−200 volts. The positive and negative high dc signal outputs are imposed across a pair of inputs 404 and 406 of a second stage 428. The second stage 428 includes four switches 408*a*–408*d* that switch the high voltage outputs to an inductor 410. A reservoir capacitor 412 stores energy for peak current conditions, such as the initial voltage pulse of a series of voltage pulse. The display 101 is primarily capacitive in nature, therefore, a series inductor-capacitor circuit is formed by the inductor 410 and display 101. An enable 414 turns off the first stage during load time and turns on the first stage during illumination time.

Figures 14, 17:
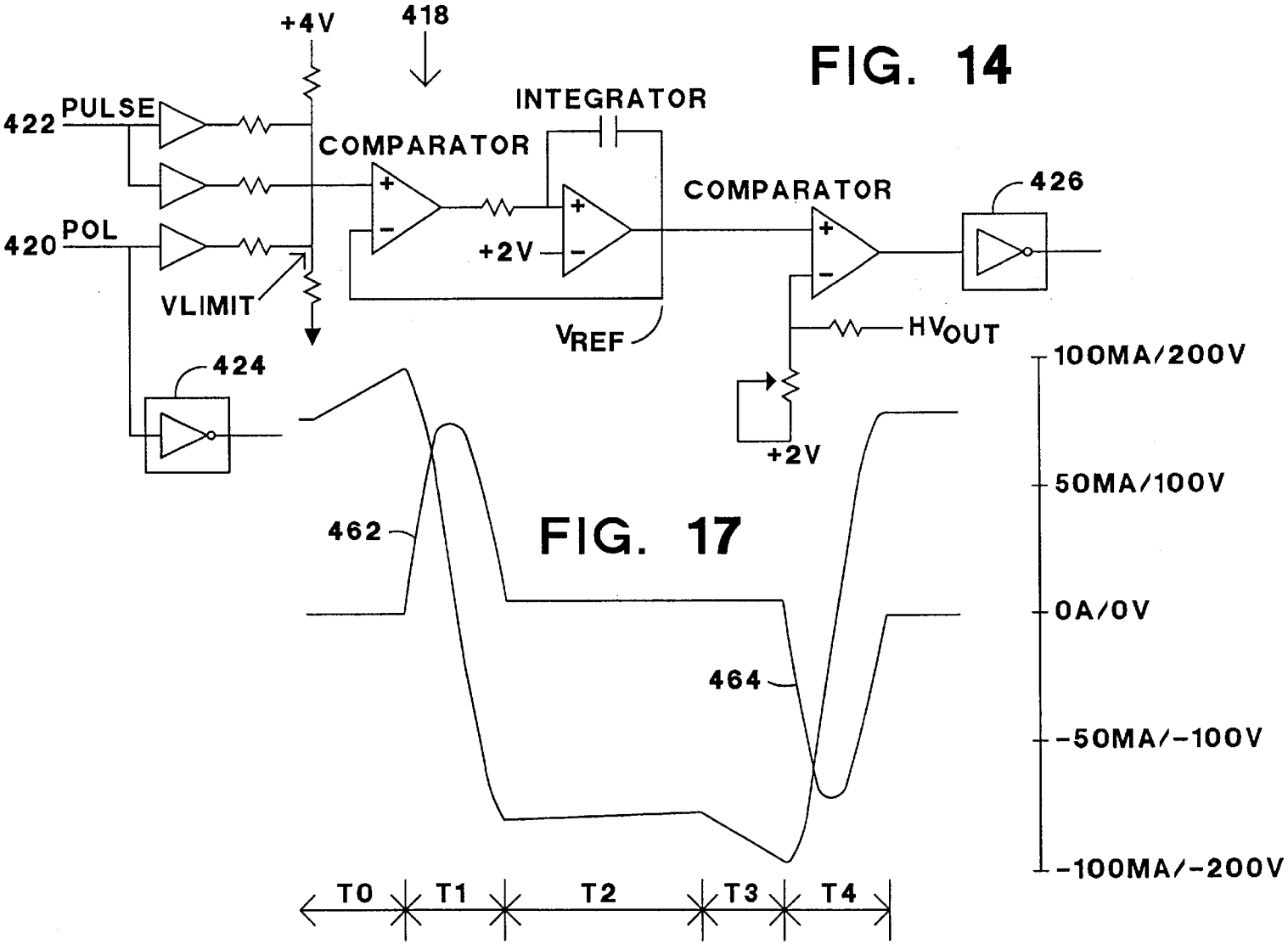
FIG. 14 is an existing control circuit for the driver circuit of FIG. 13.
FIG. 17 is a timing chart for the driver circuit of FIG. 16.

Referring to FIG. 14, a control circuit 418 controls the timing of the four switches 408*a*–408*d*. A digital pol input 420 and a digital pulse input 422 from a field programmable gate array (not shown) are inputs to the control circuit 418. A first combination inverter and level switcher 424 controls which one of the first set of switches 408*a* and 408*b* is on and off. A high voltage on the pol input 420 turns the first switch 408*a* to either an open or closed position while also setting the second switch 408*b* to the opposite position. A second combination inverter and level switcher 426 controls which of the second set of switches 408*c* and 408*d* is on and off. A high voltage at the output of the switcher 426 sets the third switch 408*c* to either an open or closed position while setting the fourth switch 408*d* to the opposite position. In other words, for each set of switches 408*a*, 408*b* and 408*c*, 408*d*, one switch is on while the other switch is off. Also, the switches are designed with a "break before make" to assure that when alternating which are open and closed, the open switch is closed before the previously closed switch is opened.

The combination of the first stage 400, second stage 428, and control circuit 418 provides a driver circuit that is relatively robust, albeit complicated. Such a circuit is suitable for the generation of illumination waveforms for an indeterminate period of time by using the enable 414. Unfortunately, the number of electronic components required to construct such a circuit is high and each electronic component has an associated resistive loss which decreases the efficiency of the circuit.

Figure 15:
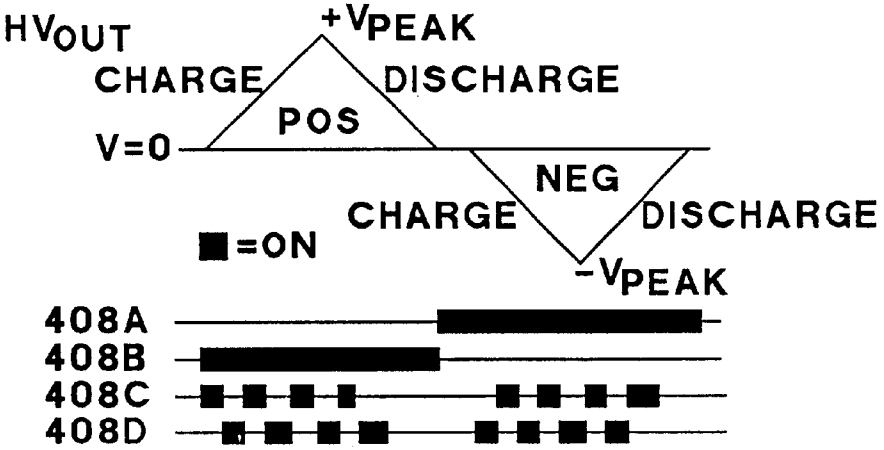
FIG. 15 is a timing chart for the driver circuit of FIG. 13.
Figure 18:
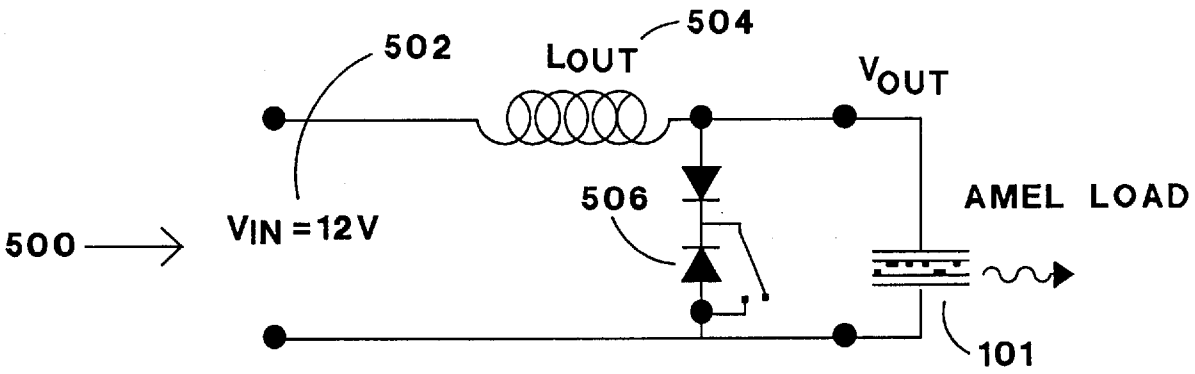
FIG. 18 is an alternative exemplary schematic of a single stage driver circuit of the present invention suitable for the timing technique shown in FIG. 10.
Figure 19:
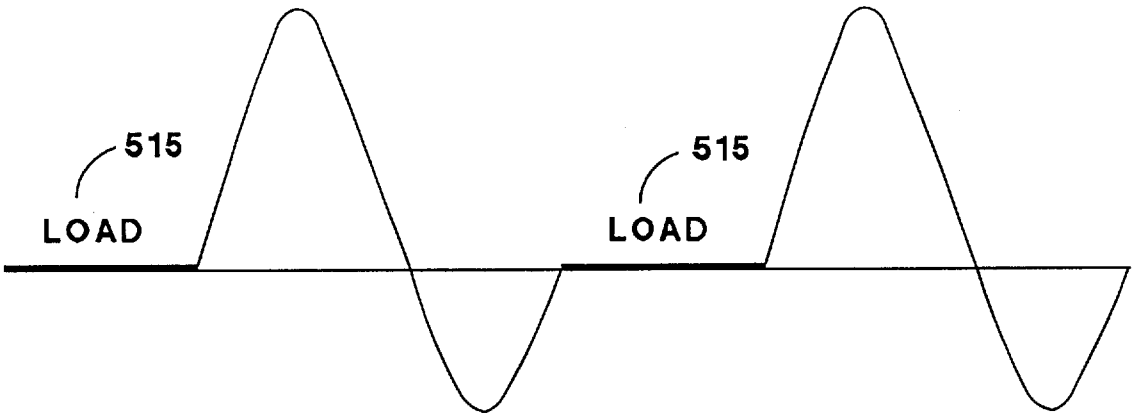
FIG. 19 is a timing chart for the driver circuit of FIG. 18.

Referring to FIG. 15, the HVout waveform 433 is shown schematically together with the settings for the switches 408*a*–408*d*.

Figure 16:
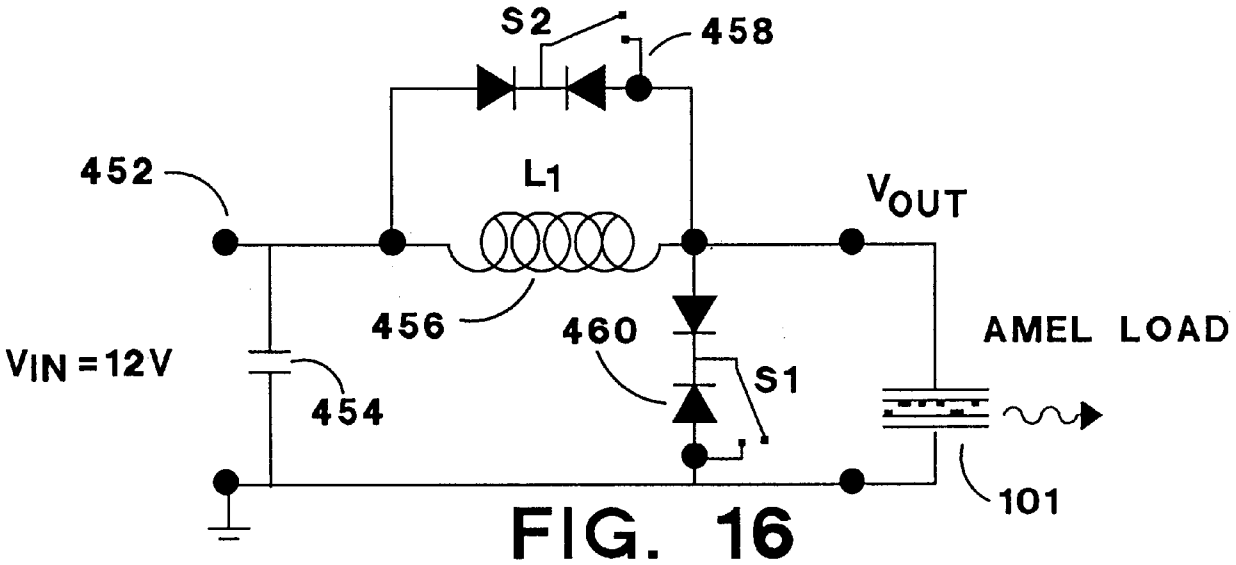
FIG. 16 is an exemplary schematic of a single stage driver circuit of the present invention suitable for the timing technique shown in FIG. 10.

Referring to FIG. 16, an improved driver circuit 450, including only a single stage, is suitable for repetitive generation of the same waveform at relatively constant timing, as required for the present invention. A low dc voltage input 452 is preferably 12 volts. A small filter cap 454 may be included to filter high frequency noise from the power supply, if desired. The driver circuit 450 includes a single inductor 456 and a pair of switches 458 and 460 to provide a high voltage illumination signal to the display 101, which is primarily capacitive in nature. Referring also to FIG. 17, initially switch 460 is closed and switch 458 is opened to charge the inductor 456 with energy during time period TO. Then at the desired beginning of the positive going illumination waveform 462 switch 460 is opened and switch 458 remains open allowing the inductor 456 to ring. During the ring time T1 the energy stored in the inductor 456 is imposed across the display 101 as a generally sinusoidal waveform. When the illumination waveform returns near zero volts switch 460 is closed and switch 458 remains open. This provides a relatively short time period T2 during which energy is again stored in the inductor 456 to replenish energy lost through resistive losses in the system. Time period T2 may be omitted, if desired. Then switch 460 is opened and switch 458 is closed to charge the inductor 456 with energy during time T3. Then switch 458 is opened and switch 460 remains open to permit the inductor 456 to ring. During the ring time T4 a negative going generally sinusoidal illumination waveform 464 results. When the illumination waveform 464 returns near zero volts, switch 460 is closed and switch 458 remains open. By modulating the duration of the charge times of the inductor 456, the peak voltage output of the illumination waveform can be controlled. The improved driver circuit 450 includes considerably fewer electronic components and is therefore much more efficient.

The capacitive load of the display 101 varies based on the number of pixels displayed during any particular subframe. The greater the number of pixels displayed the greater the capacitance of the display. Accordingly, it is preferable to regulate the energy stored in the inductor 504 and 456 during each load period, prior the illumination waveform being applied to the display, in order to accommodate for differences in the capacitance of the display 101. More energy is 15 required when more pixels are displayed.

There are several methods suitable to accommodate for differences in the capacitance of the display 101. A first method is to modulate the magnitude of the low voltage DC input 502. The input 502 would be increased when the capacitance of the display 101 is larger and decreased when the capacitance of the display 101 is smaller. A second method is to modulate the time during which the loading of the data 515 occurs. For example, the data load time may be increased by delaying the time before the switch 506 is opened. A third method is to modulate both the low voltage DC input 502 and the data load time 515.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method of illuminating an active matrix EL device (AMEL) to provide a gray scale display, said device comprising a first electrode layer comprising an active matrix of individually addressable pixel electrodes, a second electrode layer, and a thin film EL laminate stack including at least an EL phosphor layer and a dielectric layer, said stack being disposed between said first and second electrode layers, comprising the steps of:

(a) addressing a first group of selected ones of said pixel electrodes comprising multiple rows with data signals during a first subframe time period where said first group includes fewer than all of said pixel electrodes of said display;

(b) driving said second electrode layer during said first subframe time period with a first illumination signal so that a plurality of pixels corresponding to said first group of said selected ones of said pixel electrodes will be simultaneously illuminated together with at least one pixel corresponding to a pixel electrode not addressed during said first subframe time period;

(c) addressing a second group of selected ones of said pixel electrodes comprising multiple rows with data signals during a second subframe time period where said second group includes at least one pixel electrode not included within said first group and said first group includes at least one pixel electrode not included within said second group;

(d) driving said second electrode layer during said second subframe time period with a second illumination signal so that a plurality of pixels corresponding to said second group of said selected ones of said pixel electrodes will be simultaneously illuminated together with at least one pixel corresponding to a pixel electrode not addressed during said second subframe time period.

2. The method of claim 1 further including the steps of repeating steps (c) and (d) for n subframe time periods until an entire frame of data has been written.

3. The method of claim 1 where said illumination signal of step (b) and said illumination signal of step (d) are voltage pulses having an amplitude in the range of 200 volts.

4. The method of claim 1 wherein there is a time delay between said driving of step (b) and said driving of step (d).

5. The method of claim 1 wherein said second group of said selected ones of said pixel electrodes and said first group of said selected ones of said pixels are mutually exclusive sets of said pixel electrodes.

6. The method of claim 1 wherein said addressing of step (a) includes determining whether each pixel electrode of said first group should be "on" or "off"0 and said addressing of step (c) includes determining whether each pixel electrode of said second group should be "on" or "off".

7. The method of claim 2 wherein said n subframe time periods are of the same time duration.

8. The method of claim 2 wherein an illumination signal during each of said n said subframe time periods has the same number of pulses.

9. The method of claim 8 wherein said number of pulses is one cycle.

10. The method of claim 2 wherein each of said pixel electrodes of said display are selectively turned "on" "off" during selected ones of said n said subframe time periods.

11. The method of claim 1 wherein said first illumination signal and said second illumination signal includes a different number of pulses.

12. A method of illuminating an electroluminescent device comprising the steps of:

(a) providing a plurality of layers including at least a transparent electrode layer, a circuit layer, and at least two layers including an electroluminescent layer and a dielectric layer, said at least two layers disposed between said circuit layer and said transparent electrode layer;

(b) receiving a low voltage generally DC input waveform and in response providing said input waveform to a first terminal of an inductor;

(c) changing current from said input waveform passing through said inductor by alternatively increasing said current passing through said inductor thereby increasing energy stored in said inductor and thereafter decreasing the current passing through said inductor from said input waveform to cause a second terminal of said inductor to provide a high voltage generally sinusoidal waveform to said transparent electrode layer of said electroluminescent device.

13. The method of claim 12 wherein said changing is performed using at least one switch connected to said second terminal of said inductor.

14. The method of claim 13 wherein said switch is connected between said second terminal of said inductor and ground.

15. The method of claim 12 wherein said changing is performed using at least one switch connected in parallel with said device.

16. The method of claim 13 wherein said changing is performed using at least one switch connected in parallel with said inductor.

17. The method of claim 16 wherein said at least one switch connected in parallel with said inductor is connected directly to said first terminal and said second terminal of said inductor.

18. The method of claim 13 wherein said at least one switch connected to said second terminal of said inductor includes a diode and a transistor.

19. The method of claim 12 wherein said high voltage generally sinusoidal waveform is in the range of 200 volts.

20. A driver circuit for providing a generally sinusoidal illumination signal to an active matrix thin-film electroluminescent display comprising:

(a) said driver circuit receives a low voltage generally DC input waveform and in response provides said input waveform to a first terminal of an inductor;

(b) a switching circuit changing current from the input waveform passing through the inductor by alternatively increasing the current passing through the inductor thereby increasing energy stored in the inductor and thereafter decreasing the current passing through the inductor from the input waveform to cause a second terminal of the inductor to provide a high voltage generally sinusoidal waveform to the transparent electrode layer of the electroluminescent device.

21. The driver circuit of claim wherein said switching circuit includes at least one switch connected to said second terminal of said inductor.

22. The driver circuit of claim 20 wherein said switching circuit is connected between said second terminal of said inductor and ground.

23. The driver circuit of claim 20 wherein said switching circuit includes at least one switch connected in parallel with said device.

24. The driver circuit of claim 21 wherein said switching circuit includes at least one switch connected in parallel with said inductor.

25. The driver circuit of claim 24 wherein said at least one switch connected in parallel with said inductor is connected directly to said first terminal and said second terminal of said inductor.

26. The driver circuit of claim 21 wherein said at least one switch connected to said second terminal of said inductor includes a diode and a transistor.

27. The driver circuit of 20 wherein said illumination signal is generally in the range of 200 volts.

* * * * *

UNITED STATES PATENT AND TRADEMARK OFFICE

CERTIFICATE OF CORRECTION

PATENT NO. : 6,278,423 B1
DATED : August 21, 2001
INVENTOR(S) : Steven F. Wald et al.

It is certified that error appears in the above-identified patent and that said Letters Patent is hereby corrected as shown below:

Column 10,
Line 64, change “pixels” to -- pixel --

Column 11,
Line 34, change “off0” to -- off --
Line 35, please delete “(b)”.

Signed and Sealed this

Fifteenth Day of April, 2003

JAMES E. ROGAN
*Director of the United States Patent and Trademark Office*